United States Patent [19]

Roberts

[11] 4,156,538

[45] May 29, 1979

[54] CROSS-LINKED PLASTIC BOOK COVERS

[75] Inventor: Alvin V. Roberts, Scarsdale, N.Y.

[73] Assignee: Bookwrights, Inc., Scarsdale, N.Y.

[21] Appl. No.: 764,169

[22] Filed: Jan. 31, 1977

Related U.S. Application Data

[63] Continuation-in-part of Ser. No. 490,054, Jul. 19, 1974, abandoned.

[51] Int. Cl.[2] ..... B42D 3/00

[52] U.S. Cl. ..... 281/29; 264/295

[58] Field of Search ..... 281/29, 37.5, 21; 16/DIG. 13; 204/159.3; 264/295, 163; 156/90, 477, 251, 209

[56] References Cited

U.S. PATENT DOCUMENTS

| | | | |
|---|---|---|---|
| 2,478,132 | 8/1949 | Schade | 281/29 X |
| 3,097,150 | 7/1963 | Rainer | 204/159.2 |
| 3,168,424 | 2/1965 | Sendor | 281/29 X |
| 3,414,296 | 12/1968 | Schneider | 281/29 X |
| 3,454,694 | 7/1969 | Delaire et al. | 281/29 X |
| 3,532,363 | 10/1970 | Abildgaard et al. | 281/29 |
| 3,904,227 | 9/1975 | Sendor | 281/29 |

FOREIGN PATENT DOCUMENTS

| | | | |
|---|---|---|---|
| 49933 | 2/1941 | Netherlands | 281/29 |
| 1243752 | 8/1971 | United Kingdom | 281/29 |

*Primary Examiner*—Stephen C. Pellegrino

*Attorney, Agent, or Firm*—Roy C. Hopgood; John M. Calimafde; Chas. W. Neill

[57] ABSTRACT

This method makes plastic book covers which have stiffer front and back panels and which have diminished plasticizer migration between the cover and any contacting cover or other adjacent surface. The covers are cross-linked to a limited extent to improve the elasticity of the hinge lines; and to a greater extent at the back and front cover areas to add stiffness to the plastic material. Laminated plastic covers are made with the different layers made of material that responds to cross-linking chemicals or radiation to different degrees, The covers can be made of expanded plastic and laminates.

8 Claims, 10 Drawing Figures

TIMING CONTROL
IRRADIATION STATION
AC

GENERATOR

CROSS-LINKED PLASTIC BOOK COVERS

RELATED PATENT APPLICATION

This application is a continuation-in-part of my copending application Ser. No. 490,054, filed July 19, 1974. The copending application is now abandoned.

BACKGROUND AND SUMMARY OF THE INVENTION

One-piece plastic covers made of thermoplastic sheets are advantageous for providing attractive and serviceable covers for books, and with the important savings in the cost of binding the books. With the cover made in one piece, there is a problem in providing the necessary stiffness for the front and rear covers and at the same time to have sufficient flexibility for the hinge lines of the cover.

Greater economy is possible if commercial sheets of plastic are used in the manufacture of the covers; and various methods have been used for the purpose. This invention provides further improvements in the making of plastic covers. Cross-linking of the plastic to a limited degree to improve the elasticity of the hinge portions of the cover may be used to increase the useful life of the cover. More extensive cross-linking is used to add stiffness to the parts of the cover that are the front and rear panels of the book cover.

Some features of the invention relate to laminated cover constructions with the different layers of different susceptibility to cross-linking. If maximum stiffness is desired for the front and rear cover panels, these panels can be substantially thermoset; and the cross-linking diminishes or eliminates migration of plasticizers between the cover panels and adjacent books or other surfaces such as sometimes occurs when printing contacts with a surface of a plastic cover.

Other objects, features and advantages of the invention will appear or be pointed out as the description proceeds.

BRIEF DESCRIPTION OF DRAWING

In the drawing, forming a part hereof, in which like reference characters indicate corresponding parts in all the views.

DESCRIPTION OF PREFERRED EMBODIMENT

Figures 1, 2, 3, 4, 5, 6, 7, 8, 9, 10:
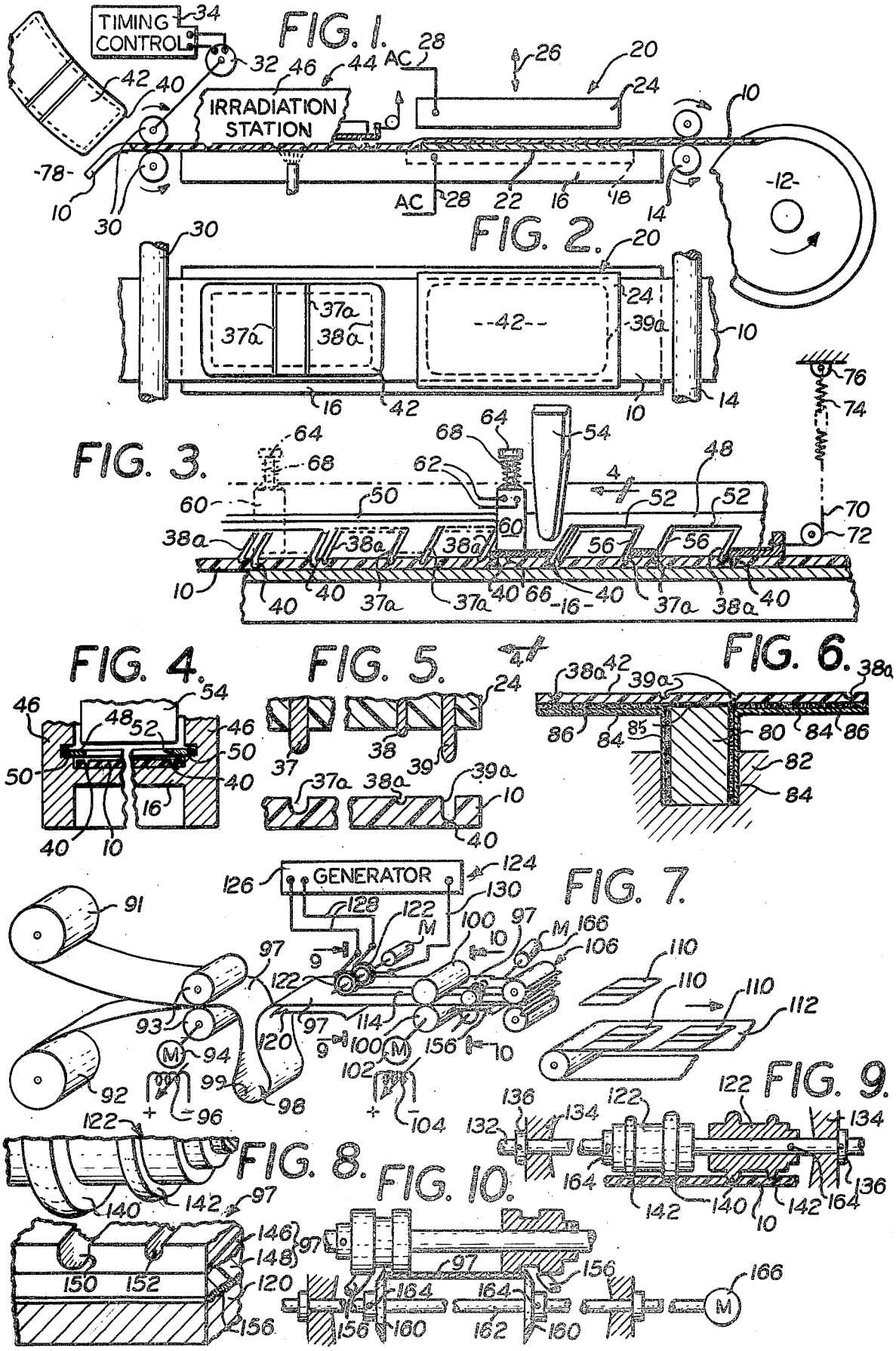
FIG. 1 is a diagrammatic view of apparatus for making book covers in accordance with this invention.
FIG. 2 is a diagrammatic top plan view of a portion of the apparatus shown in FIG. 1.
FIG. 3 is a greatly enlarged, fragmentary view of the shield used for selective cross-linking of the cover blanks shown in FIGS. 1 and 2.
FIG. 4 is a sectional view taken on the line 4—4 of FIG. 3.
FIG. 5 is a fragmentary view of part of the apparatus shown in FIG. 1.
FIG. 6 shows one possible application of a cover illustrating the way in which the cover is applied to a book while using end papers.
FIG. 7 is a diagrammatic view showing another and modified apparatus for making the covers of this invention.
FIG. 8 is a modified construction for making hinge lines and decorations on plastic covers made with laminated plastic sheets.
FIGS. 9 and 10 are diagrammatic views taken on the lines 9—9 and 10—10 of FIG. 7.

FIG. 1 shows a plastic sheet 10 which is unwound from a reel 12 and which is advanced by feed rolls 14 over a table 16. This table 16 supports a fixed electrode 18 of a dielectric heating apparatus 20. The fixed electrode 18 is covered by a barrier 22 and the sheet 10 is advanced across the top surface of the barrier 22 with intermittent motion.

The dielectric heating apparatus 20 includes also a movable electrode 24 which moves toward and from the fixed electrode 18, as indicated by the double-headed arrow 26. The electrodes 18 and 24 are connected with the opposite sides of power lines 28 which supply the high frequency energy necessary for the dielectric heating apparatus 20.

There are other feed rolls 30 driven by an electric motor 32 for moving the sheet 10 intermittently across the barrier 22. This intermittent movement is obtained by a timing control 34 which supplies power to the motor 32 to advance the sheet 10 in cooperation with the operation of the dielectric heating apparatus 20.

When a new length of the sheet 10 has been advanced under the movable die 24, this die moves downward into contact with the sheet 10 to heat the thermoplastic sheet 10, and there are metal electrode elements 37, 38 and 39 (FIG. 5) carried by the movable electrode 24 for forming grooves 37*a*, 38*a* and 39*a* in the sheet 10, as shown in FIG. 5. This is done while the sheet remains stationary between the electrodes 18 and 24.

The electrode element 39 is longer than the other electrode elements 37 and 38 so that it makes the groove 39*a* almost as deep as the full thickness of the web 10. The electrode element 39 can be made to melt the groove 39*a* all the way through the sheet 10 but it is preferable to have the groove 39*a* with a thin bottom wall 40 which provides a "tear seal" at the bottom of the groove 39*a*. By having the tear seal 40 along all or at least part of the length of the groove 39*a*, the cover is held in place in the web and advances with the web to a delivery station. The groove 39*a* extends around the entire periphery of the cover blank, as shown in FIG. 2, and this cover blank is designated by the reference character 42 in FIG. 2.

FIG. 2 shows a second cover blank 42 which is held in the web 10 as the web travels beyond the dielectric heating apparatus 20. Apparatus that covers this second blank 42 is removed in FIG. 2 so as to expose the entire area of the cover 42. The groove 38*a*, formed by the electrode element 38 of FIG. 5, is a decorative groove inward from the edges of the cover 42. This groove 38*a* can be an intermittent groove or a continuous groove in accordance with the desired decorative treatment of the cover.

A hinge line 37*a* is formed by the electrode element 37 of FIG. 5, and there is a similar hinge line 37*a* extending parallel to the first hinge line and formed by another electrode element 37 identical with that shown in FIG. 5.

Referring again to FIG. 1, there is an irradiation station 44 located above the table 16 beyond the dielectric heating apparatus 20. After each operation of the dielectric heating apparatus 20, the feed rolls 30 operate to advance the sheet 20 for a distance which brings a cover blank from the dielectric heating position between the electrodes 18 and 24 to the irradiation station in which the cover is located between the table 16 and a housing 46 that encloses the apparatus for irradiating the cover blank.

FIGS. 3 and 4 illustrate diagrammatically the apparatus for cross-linking the cover blank at the irradiation station. The sheet 10 travels along the surface of the table 16 which has side walls 46 at the radiation station. These side walls 46 support a shield 48 which has opposite edges running in grooves or channels 50 formed in the side walls 46. There are windows 52 in the shield 48. High energy electrons are discharged from the lower end of an accelerator housing 54, and these electrons strike the portions of the sheet 10 which are exposed through the windows 52.

The hinge lines 37*a* are covered by edge portions 56 of the windows 52. These edge portions are thinner than the rest of the shield 48; and they are thin enough to permit a limited degree of cross-linking of the plastic material which is under these thin portions 56 of the shield. The portions of the plastic sheet 10 which are at the open areas of the windows 52 are subject to the full impact of the radiation from the accelerator 54, and these portions of the plastic are cross-linked to the degree determined by the length of time that the plastic is subject to the radiation from the accelerator 54. The degree of cross-linking also depends upon the materials used and the compounding. This construction is merely representative of means of obtaining localized differences in the degree of cross-linking from the same radiation source.

The length of time that the plastic sheet 10 is subjected to the radiation from the accelerator 54 depends upon the speed at which the sheet 10 advances with each intermittent motion imparted to it by the feed rolls 30 (FIG. 1).

At the beginning of the movement of the sheet 10, the shield 48 is at the position shown in full lines in FIG. 3. A solenoid 60 is secured to the top of the shield 48. This solenoid has conductors 62 connecting it with the timing control 34 (FIG. 1) which operates intermittent movement of the sheet 10. The solenoid 60 operates a plunger 64 which has a point 66 at its lower end. When the solenoid 60 is energized, the plunger 64 is pulled down and forces the point 66 into the top surface of the plastic sheet 10. When the energy to the solenoid 60 is shut off, a spring 68 moves the plunger 64 upward and disengages the point 60 from the sheet 10.

Just before the plastic sheet 10 begins its intermittent movement, the solenoid 60 is energized to push the point 66 into the plastic sheet. As the plastic sheet begins to move, the shield 48 moves as a unit with it because the shield is pinned to the sheet 10 by the point 66 of the solenoid. As the sheet 10 travels to the left in FIG. 3, the shield 48 moves as a unit with the sheet and they advance past the stationary accelerator 54. As the first window 52 passes under the accelerator 54, the panel of the sheet 10, exposed through this first window 52, is cross-linked. As the thin edge 56 of the first window 52 passes under the accelerator 54, the first hinge line 37 receives a limited amount of radiation through the thin part 56 of the shield 48. The amount of radiation reaching the hinge lines 37 is sufficient to improve the elasticity of the plastic sheet 10 at the hinge lines but not enough to cross-link the plastic beyond the ideal elasticity for long life hinge lines.

As the portion of the sheet between the hinge lines 37*a* passes under the accelerator 54, there is no cross-linking of the plastic because it is under the full thickness of the shield 48. It will be understood, however, that if this part of the cover is to be cross-linked, then another window is provided between the thin shield sections 56 to permit radiation of the spine portion of the cover.

As the sheet 10 continues to advance, the second window 52 passes under the accelerator and when the sheet 10 has advanced for the full stroke of an intermittent movement, the feed rolls 30 (FIG. 1) stop and the timing control 34 opens the circuit of the solenoid 60 (FIG. 3) so that the spring 68 pulls the point 66 out of the surface of the sheet 10. This releases the connection between the shield 48 and the sheet 10 so that the shield 48 is pulled back to its original position by a flexible cable 70 which runs over a pulley 72. A tension spring 74 anchored to a fixed bracket 76 provides the force for pulling the shield 48 back to its original position. It will be understood that this construction shown in FIG. 3 is diagrammatic and merely representative of automatic means for returning the shield 48 to its starting position after each irradiation operation.

It will be understood that a different shield 48 must be provided for different size covers and with windows and shield thicknesses proportioned in accordance with the areas to be cross-linked and the degree of cross-linking desired for each area. In order to diminish or prevent migration of plasticizers and certain printing inks between a cover and another cover with which the first cover may come in contact when in use or with any other plastic surface, the amount of cross-linking of the front and back panels, which are the surfaces most likely to contact adjacent surfaces, should be cross-linked to the extent that will result in such diminution of migration. This means that a substantial part of the volume of the plastic should be thermoset.

Beyond the feed rolls 30 (FIG. 1), the sheet 10 reaches a delivery station 78 at which successive covers 42 are torn from the sheet 10 along the tear line 40; and the cover is then ready to be applied to a book filler. Selective cross-linking can be done without a shield by having localized radiation stations, but the illustrated apparatus has the advantage of a single cross-linking station. Different kinds of radiation can be used.

FIG. 6 shows the cover 42 applied to a book filler 80 which is held in a clamp 82. Such plastic covers 42 can be applied directly to the spine of the filler 80; but FIG. 6 shows a special construction in which end papers 84 are secured to the filler 80 and the front and back cover panels of the cover 42 by adhesive 86, which may be pressure sensitive.

The cover shown in FIG. 6 may be cross-linked, after it has been applied to the book filler 80, with or without end papers 84, and adhesive 85 may be used on the book filler spine if a tight back book is desired. In such a case, the adhesive can be a polymer based adhesive, which can be fluid at room temperature and without the use of solvents, water or dispersing agents that have to evaporate. Such a polymer based adhesive can be set substantially instantaneously by cross-linking it at the same time that selective, unshielded portions of the cover are cross-linked. Polymer based inks used for printing the cover are also cross-linked; and synthetic hot foils may also be cross-linked.

Preferred adhesives are polymeric materials such as polyolefins, hot-melt adhesives based on polyvinyl acetate and copolymers of ethylene and vinyl acetate, and liquid adhesives based on polyesters and nitrile rubbers, which can be cross-linked.

FIG. 7 shows two rolls of sheet material 91 and 92. These rolls contain different kinds of material which are brought together by feed rolls 93 driven by a motor 94 which has a speed control 96. The feed rolls 93 operate continuously and are heated and under pressure, preferably with adhesive, so that they bond the plastic sheet materials from the reels 91 and 92 together in a laminated sheet 97 which enters an accumulator station 98 where the sheet is formed into one or more loops 99 beyond the feed rolls 93. The material 91 or 92 may be an expanded or a spunbonded material, if desired. The materials 91 and 92 may be cross-linked before laminating, and in the case of the layer 92, the cross-linking is to the extent necessary to improve the hinge life. The expression "expanded" is used to designate a foamed material, preferably with closed cells.

There are other feed rolls 100 driven by a motor 102 which has a speed adjustment 104 for bringing the speed of the feed rolls 100 into general synchronism with the rolls 93; but the loop 99 provides for irregularities in the respective speeds of the motors 94 and 102, or for temporary interruptions at locations beyond.

The feed rolls 100 supply the laminated sheet 97 to a flying shear 106 which cuts the sheet into separate book covers 110 which are discharged by the flying shear 106 onto a conveyor belt 112.

On its way from the loop 99 to the flying shear 106, the laminated sheet 97 passes through several processing steps. The first processing step is the formation of hinge lines 114. These are formed by passing the laminated sheet 97 over a supporting table 120 and under rollers 122 which are the upper electrodes of dielectric heating apparatus 124. The high frequency power is supplied by a generator 126 connected with the rolls 122 by conductors 128 having brushes at their lower ends in contact with the rolls 122. The other side of the dielectric heating apparatus is the supporting table 120 which is connected with the high frequency generator by a conductor 130. The rolls 122 are shown on a larger scale in FIG. 9. These rolls 122 are on a shaft 132 which rotates in bearings 134 which are part of a fixed frame of the apparatus. The shaft 132 is held against axial movement by thrust collars 136 and the rolls 22 can be adjusted axially along the shaft 132 to change their spacing from one another in order to change the distance between the flanges 140 which form the hinge lines. Other decorative grooves are made in the laminated sheet by flanges 142 which are of smaller diameter than the flanges 140. These flanges function as rotary electrodes, and they are preferably in continuous contact with the sheet.

FIG. 8 shows, on a larger scale, the way in which the flanges 140 form hinge lines in the preferred construction of the laminated sheet 97. The upper layer of the laminated sheet 97 is made of material which is highly responsive to dielectric heating. This upper layer is designated in FIG. 8 by the reference character 146, and this layer may be expanded, foamed, or cellular, if desired, the terms being used herein as synonyms. The lower layer, designated by the reference character 148, is made of material which is not responsive to dielectric heating or much less responsive than the upper layer 146, such as polyethylene and polypropylene and copolymers of ethylene and propylene. Because the bottom layer is substantially nonresponsive to dielectric heating, the displacement of the upper layer material by the flange 140 uniformly defines the hinge thickness to that of the bottom layer. The smaller flange 142 makes a shallower groove since this flange does not extend downward as far as the larger flange 140; both are connected to the same hub, as shown in FIG. 9.

The plastic material shown in FIGS. 1–6 can be an expanded plastic, if desired, but the laminate has advantages if the front and back panels of the cover are to be made of expanded plastic, because the second layer of the laminate can provide the hinge lines by underlying grooves in the upper layer; and no grooves in the lower layer are necessary if the lower is sufficiently flexible.

An outstanding advantage of using an expanded plastic and then cross-linking it is that the cross-linking provides the necessary strength; and for a panel having the same amount of plastic per unit of area, the cross-linked foam panel is much stronger because its greater thickness locates portions of its volume further from any neutral axis about which the cover may tend to bend when in use.

In FIG. 8 the hinge line is designated by the reference character 150, and the smaller decorative line is indicated by the reference character 152. FIG. 8 also shows a barrier layer 154 below the laminated sheet 97 and in fixed position ove the metal electrode 120.

FIG. 10 shows the way in which excess edge material 156 is cut from both edges of the laminated sheet 97 by rotary cutter blades 160 to trim the sheet 97 to the desired width of the covers 110.

Like the rolls 122 in FIG. 9, the cutters 160 of FIG. 10 are adjustable along a shaft 162 and are locked in adjusted position by set screws 164. The shaft 162 is driven continuously by a motor 166.

In order to have the cover heated by a high frequency electric field, it is necessary to use a plastic material which is heated in the presence of such an electric field. The preferred material is polyvinyl chloride or polyurethane. Copolymers of vinyl chloride with vinylidine chloride or vinyl acetate are also suitable, but the vinyl chloride should be the predominant monomer. The term "polyvinyl chloride" as used herein includes such copolymers.

Other materials for the web 10 or 91 include polyvinyl acetate; copolymers of vinyl chloride and vinyl acetate; copolymers of vinyl chloride and vinylidene chloride; copolymers of ethylene and vinyl acetate; polyamide (nylon); polyurethanes; homopolymers of polyvinylidene chloride; copolymers of vinylidene chloride and lesser amounts of other unsaturated compounds ("Saran"); and polyvinyl butyrate. The above materials can be used with plasticizers where appropriate.

The covers of this invention are equally applicable to permanently bound books, and mechanical binders such as ring binders, post binders, and clip or clasp binders, and other covers are used on pad holders.

The covers made in FIGS. 7–10 can be used cross-linked in their entirety or with selective area cross-linking as in FIGS. 1–5. They can be cross-linked on the belt 112 (FIG. 7) or after application to a book filler, such as shown in FIG. 6. When cross-linked after printing the cover and applying it to the filler with adhesive as in FIG. 6, the bond of the ink and the adhesive to the cover material is improved by the cross-linking.

Where desirable to form hinge lines by externally heated rules or wheels, such heating may be used in place of dielectric heating; as in the case of plastic materials which do not respond to the dielectric heating. Likewise, other ways of severing the covers from the sheets can be used, such as dies other than that shown in FIG. 1.

The preferred embodiment of the invention has been illustrated and described, but changes and modifications can be made and some features can be used in different combinations without departing from the invention as defined in the claims.

What is claimed is:

1. The method of making a book cover having front and back cover panels connected to a spine panel along hinge lines, which method comprises:

(a) forming the cover of plastic material that is thermoplastic and of a thickness and flexibility unsuitable for a book cover, because of characteristics of the material for hinge lines that connect the cover panels with the spine panel or flexibility unsuitable for the front and back panels of the cover;

(b) forming hinge lines at the locations where the cover panels connect with the spine panel;

(c) making the front and back cover panels stiffer than other parts of the cover by cross-linking them by irradiation to a greater degree than the other parts of the cover to make the front and back panels stiff enough to be suitable for book covers, and maintaining the irradiation of the front and back panels for a sufficient time to diminish migration, of any plasticizer in the plastic, between the cover and a second cover or other plastic surface with which the cross-linked cover comes in contact; and (d) selectively exposing the hinge lines of the cover by shielding means that limit the irradiation to a lesser dosage than that of the cover panels, and limiting the exposure of the hinge lines to a period that will improve the hinge life of the hinge lines without excessive stiffening of the plastic material of the hinge lines.

2. The method described in claim 1 characterized by passing a sheet of plastic through a cut-out station, forming hinge lines in the cover area at regions where the front and back panels join a spine panel of the cover, forming a groove that outlines the cover area at the cut-out station, the groove having a depth substantially equal to the thickness of the sheet so as to serve as a tear line, and holding the cover in its original position in the sheet to maintain the cover in position during the selective cross-linking of the cover, and thereafter removing the cover, as outlined by the tear line, from the remainder of the sheet.

3. The method described in claim 1 characterized by passing a sheet of plastic material through a cut-out station, impressing the outline of the cover in the plastic sheet at the cut-out station, advancing the sheet to a crosslinking station with the area that forms the cover in its original position in the sheet to control register of the cover with apparatus that does the crosslinking, and removing the cover from the sheet after the cover has been crosslinked.

4. The method described in claim 1 characterized by making a plurality of book covers from a single sheet of thermoplastic material by advancing the sheet through a cut-out station at which hinge lines are formed by making depressions in the sheet at the sides of the front and back cover panels that are closest to one another and substantially simultaneously therewith forming a groove having a depth substantially equal to the thickness of the sheet to leave at the bottom of the groove a tear line along which the cover can be torn loose from the sheet, and leaving the tear line intact to maintain the cover in its fixed position in the sheet while advancing the sheet from the cut-out station to a cross-linking station.

5. The method described in claim 4 characterized by moving the sheet with a stop-and-go movement during the cutting out of the cover and during crosslinking thereof, forming the hinge lines and the tear line while the cover is stopped, and crosslinking the cover while it is moving as a unit with the sheet.

6. The method described in claim 1 characterized by making the cover of plastic material which is expanded at the areas of the cover that constitute the front and back panels of the cover, crosslinking the expanded plastic of the front and back panels to increase their stiffness, the greater thickness resulting from the expanded condition of the plastic causing increase in stiffness as a result of the location of portions of the expanded plastic further from any neutral axis, about which the cover panels tend to bend, as compared to unexpanded plastic of equal weight per unit area.

7. The method described in claim 1 characterized by using for the cover an unsupported, synthetic high polymer material that is heatable to a softening temperature by exposure to a dielectric field, and softening the cover material by dielectric heating, and while so heated, forming hinge line grooves in the softened material and also a groove that serves as a line of severance of the cover from the remainder of the polymer material.

8. The method described in claim 1 characterized by applying crosslinkable adhesive to the cover, applying the cover to a book filler with crosslinkable adhesive in contact with the filler, and crosslinking the adhesive after the cover and filler are assembled as a book.

* * * * *